US006976322B1

(12) United States Patent
Walker

(10) Patent No.: US 6,976,322 B1
(45) Date of Patent: Dec. 20, 2005

(54) MOLDED ORTHOTIC INSERT

(75) Inventor: John Walker, Ferndale, WA (US)

(73) Assignee: Superfeet Worldwide LP, Ferndale, WA (US)

( * ) Notice: Subject to any disclaimer, the term of this patent is extended or adjusted under 35 U.S.C. 154(b) by 27 days.

(21) Appl. No.: 10/698,919

(22) Filed: Oct. 31, 2003

(51) Int. Cl.[7] ..... A43B 13/38
(52) U.S. Cl. ..... 36/43; 36/145; 36/166; 36/173
(58) Field of Search ..... 36/43, 44, 145, 36/166, 173

(56) References Cited

U.S. PATENT DOCUMENTS

| | | | | |
|---|---|---|---|---|
| 1,456,843 | A | 5/1923 | Clark | |
| 1,517,170 | A | 11/1924 | Rosenthal | |
| 2,139,971 | A | 12/1938 | Pava | |
| 2,146,888 | A | 2/1939 | Fisch | |
| 4,435,910 | A | 3/1984 | Marc | |
| 4,619,056 | A | 10/1986 | Lin et al. | |
| 4,776,109 | A * | 10/1988 | Sacre | 36/3 B |
| 5,282,326 | A * | 2/1994 | Schroer et al. | 36/44 |
| 5,394,626 | A | 3/1995 | Brown | |
| 5,625,965 | A * | 5/1997 | Blissett et al. | 36/43 |
| 5,722,186 | A * | 3/1998 | Brown | 36/43 |
| 6,131,311 | A * | 10/2000 | Brown et al. | 36/43 |
| 6,192,607 | B1 | 2/2001 | Kolada et al. | |
| D461,300 | S | 8/2002 | Hall | |
| 2002/0007569 | A1 * | 1/2002 | Crane et al. | 36/44 |
| 2003/0024134 | A1 * | 2/2003 | Howlett et al. | 36/43 |
| 2003/0150134 | A1 * | 8/2003 | Hardt | 36/44 |

* cited by examiner

*Primary Examiner*—Marie Patterson
(74) *Attorney, Agent, or Firm*—Todd N. Hathaway

(57) ABSTRACT

A one-piece molded orthotic insert having a shape for controlling and directing the motions of the foot. The insert has a unitary body that is formed of a rigid, resiliently flexible, substantially noncompressible material, so that the insert will flex with the shoe but will not compress or deform, so that a correct shape is maintained through the gait cycle. The insert includes a raised arch portion that is supported by a plurality of underlying, vertical ribs. The ribs are spaced apart and free from connection with one another, so that the lower edges of the ribs are able to spread as the insert flexes along its lengthwise axis, so that the insert flexes generally uniformly when walking and without distortion of its shape. The layer of material overlying the ribs has a thickness generally similar to that in the reset of the body, and the ribs also have a generally similar thickness, facilitating manufacture by injection molding. A depending ridge extends around the lower surface of the insert for pressing into an insole so as to stabilize the insert against sliding or shifting in the shoe. The present invention provides many of the advantages of a custom orthotic using a more economical insert, and due to its thin vertical height it is especially suited for use with dress shoes.

11 Claims, 3 Drawing Sheets

MOLDED ORTHOTIC INSERT

BACKGROUND a. Field of the Invention

The present invention relates generally to orthotic devices for feet, and more particularly, to a thin, substantially rigid orthotic formed of molded material and having a shape for controlling and directing the motions of a foot.

b. Related Art

Orthotic inserts (referred to herein as "orthotics") are devices intended to be placed in shoes and other footwear to cooperate with the plantar surfaces of the wearer's feet.

Orthotic inserts can be either soft or hard. Soft inserts are typically constructed of one or more layers of resiliently compressible foam material, with the foam being thicker in some areas and thinner in others to provide particular contour with respect to a foot. The cushioning effect of the foam material, which compresses under the weight of the foot, is often seen as the primary benefit of such devices, but this is in fact somewhat misleading. Although a degree of cushioning is indeed desirable for certain applications, such as for use in running, hiking and athletic shoes, the most significant benefit of an orthotic insert comes from its ability to control and direct the motions of the foot as the foot progresses through the gait cycle. As is known, the foot progresses from a "mobile adapter" phase at heel strike, in which the foot flexes and absorbs impact loads, to a "rigid lever" at toe-off phase in which the foot locks up for effective propulsion. This biomechanical action is dependent on the proper locking and unlocking of the joint structure of the foot, which in turn is dependent on the proper motion of the foot. It is therefore a primary concern that the orthotic device provide proper control and direction of these motions.

Due to their yielding and flexible nature, it is difficult for soft, foam orthotics to exert the requisite degree of control over the motions of the foot. These difficulties have been overcome in certain soft orthotics through the addition of various stiffening or supporting elements formed of a comparatively rigid or less compressible material. For example, some soft orthotics employ an underlying rigid cap that is configured to provide the foam layers with added support and resistance in selected areas. Nevertheless, the control over the motions of the foot is inevitably compromised to one degree or another by the soft, yielding nature of the foam material.

As noted above, the cushioning qualities of compressible material provides make the trade-off worthwhile in the case of certain high-impact activities. For dress shoes, however, the cushioning qualities of the soft orthotic are of comparatively little benefit, even though control of the motions of the foot remains essential. Moreover, dress shoes, as compared with running, hiking or athletic shoes, are traditionally constructed with relatively tight-fitting uppers, so that there is very little excess room in the shoe to accommodate the height that is inherent in a soft, compressible orthotic device, especially since (as noted above) the best of the soft devices have a built-up construction using layers of foam and more rigid materials. As a result, using a soft orthotic in a dress shoe frequently causes the foot to be squeezed against the upper, causing discomfort and possibly creating abrasion and blisters. This is especially true in the case of the typical consumer, where the shoe is fitted only to the foot at the time of purchase and the consumer wishes to install an orthotic insert at a later time.

Rigid orthotic inserts tend to be thinner than soft orthotic inserts, and are therefore frequently more suited to use in a dress shoe. Moreover, rigid orthotic inserts, as a class, offer the prospect of increased control over the motions of the foot. However, prior rigid orthotics inserts have exhibited drawbacks of their own. Many of these devices have been constructed using cast urethane, which is comparatively thick and heavy and also tends to crack with extended use. In this regard, it should be understood that while "rigid" orthotics have a high degree of rigidity as compared with soft orthotics, a certain degree of flexibility and a high level of resilience are still required in order to accommodate the flexing and bending motions of the foot and insole.

Other rigid inserts have been constructed using layers of fiberglass-resin and graphite fiber-resin material, which gives a near optimal combination of thinness, strength and durability, but at a comparatively high cost: not only are the fiber-resin materials comparatively expensive, but manufacture of the inserts requires a fairly involved and labor-intensive process in which the layers are cut from sheets of material and then laminated and shaped over a cast or other form. As a result, fiber-resin construction is usually reserved for high-end, custom or semi-custom orthotics. However, not only are the costs of custom orthotics generally beyond the budgets of many consumers, but in fact the bulk of the benefits can be achieved using a standardized orthotic, provided that it has the right shape and other qualities for controlling and directing motions of the foot.

Accordingly, there exits a need for an orthotic insert having sufficient rigidity to properly control the motions of the foot that can be manufactured efficiently and at low cost. Furthermore, there exists a need for such an orthotic insert that has sufficient resilient flexibility that it is able to bend together with the foot and shoe as the foot progresses through the gait cycle. Still further, there exists a need for such an orthotic insert that maintains the correct shape and contour such that the foot is properly supported and controlled in the shoe. Still further, there exists a need for such an orthotic insert that has a thin vertical dimension so that the orthotic insert can be used in a conventional dress shoe without crowding the foot therein. Still further, there exists a need for such an orthotic insert that is durable and long lasting in service and is resistant to cracking and other sources of failure.

SUMMARY OF THE INVENTION

The present invention has solved the problems cited above, and is a one-piece molded orthotic insert. Broadly, this comprises: a one-piece body having an upper surface shaped to engage a plantar surface of a foot so as to control and direct the motions thereof, the insert being formed unitarily of a molded rigid, resiliently flexible, substantially noncompressible material; a raised arch portion formed on a medial side of the one-piece body; a cutout area formed in the body below the arch portion so that an upper layer of the molded material has a thickness in the arch portion that is generally similar to a thickness of the material in other areas of the body; and a plurality of generally vertical ribs formed on the body in the cutout area, the ribs extending downwardly from the upper layer of molded material and having lower edges for engaging an insole of the shoe, so that the ribs will support the arch area and prevent the upper layer of material from collapsing and changing shape under the foot during use.

The plurality of ribs may extend generally parallel to one another and perpendicular to a lengthwise axis of the insert.

Each of the ribs may be separated from adjacent ribs by a spaced gap over substantially a full height thereof, from the upper layer to the lower edges of the ribs.

Each of the ribs may be substantially straight in horizontal cross section and extend in a plane substantially perpendicular to the lengthwise axis of the insert. Each of the ribs may comprise a generally outwardly extending lower edge for engaging the insole of a dress shoe, and a generally upwardly extending outer edge for accommodating an upper portion of the shoe, the lower and outer edges being free from attachment to the edges of adjacent ridges.

The ridges preferably terminate a spaced distance medially from a lengthwise centerline of the insert, so that a central portion of the lower surface of the insert is free of the ribs so as to have minimal thickness generally along a lengthwise centerline of the shoe.

The insert may further comprise a depending ridge formed on the body generally around a perimeter of the lower surface thereof, for penetrating into an insole of a shoe in response to pressure exerted downwardly on the insert by a foot, so as to stabilize the insert against sliding or shifting in the shoe. The lower surface of the insert may be generally convexly curved so as to conform to a concavely curved insole, and the depending ridge may extend between the lengthwise centerline of the insert and the ribs so as to be able to engage the insole when the insert is loaded on the medial side thereof. Furthermore, the insert may be a ¾-length insert having a forward edge configured to be positioned proximal the metatarsal head area of the foot, and the depending ridge may extend at a spaced distance therefrom so as to form a thin forward lip for being positioned beneath and proximal the metatarsal head area of the foot.

Each of the ridges may have a thickness generally similar to the thickness of the material in the upper layer of the body. The rigid, resiliently flexible, substantially noncompressible material of the may be injection-molded plastic.

These and other features and advantages of the present invention will be apparent from a reading of the following detailed description with reference to the accompanying drawings.

DETAILED DESCRIPTION

The present invention is a one-piece orthotic insert that provides significant advantages in terms of both function and in the manner in which it is manufactured. More specifically, the present invention provides an orthotic insert that not only effectively controls and directs the motions of the foot, but which can also be manufactured inexpensively using conventional injection molding processes.

Figure 1:
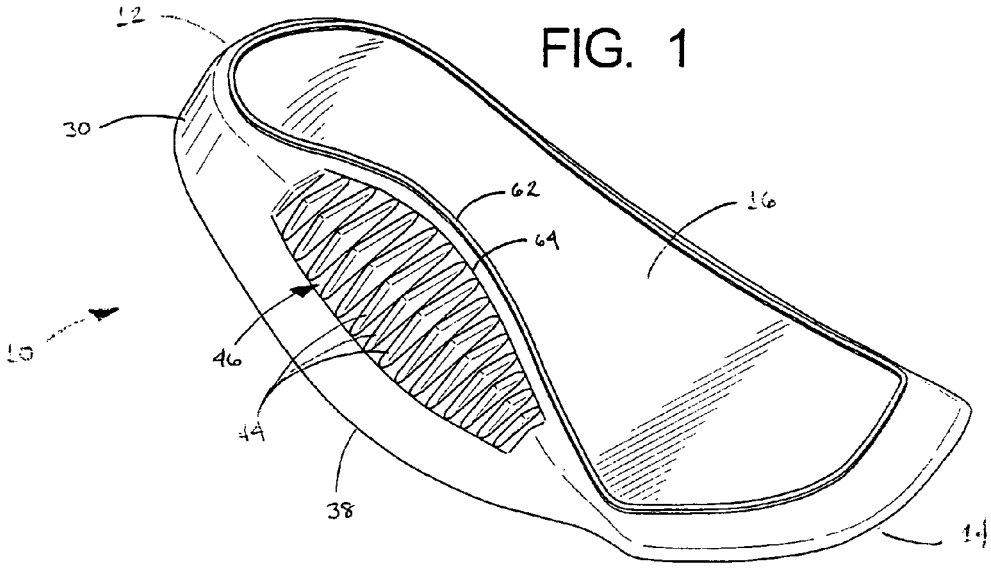
FIG. 1 is a bottom, perspective view of a molded orthotic insert in accordance with the present invention, showing a ribbed structure that forms a support in the arch area of the insert, the insert which is shown in FIG. 1 being for use with the left foot.

As can be seen in FIG. 1, the molded orthotic insert 10 of the present invention is a one-piece, unitary structure. As will be described in greater detail below, the insert 10 is formed of an injection-molded plastic that is substantially rigid but somewhat resiliently flexible when in its cured form. In some embodiments, a thin top cover (e.g., cloth) or other layer may be added, but in the illustrated embodiment the upper surface of the insert itself is formed with a slight pebble finish or other texturing that is both comfortable and prevents the device from feeling slippery under a sock.

Figure 2:
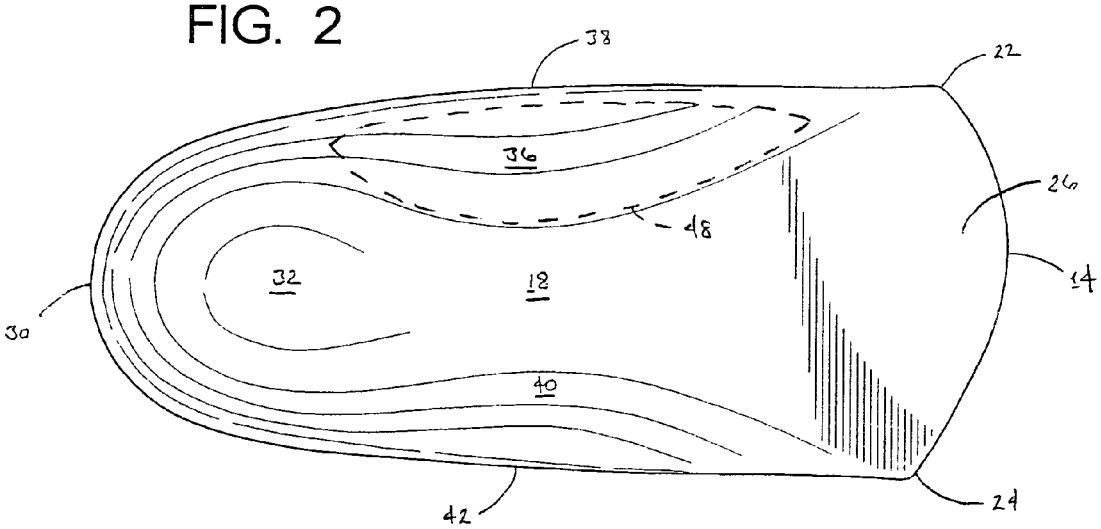
FIG. 2 is a top, plan view of the molded orthotic insert of FIG. 1, showing the shape of the upper surface of the insert in greater detail.
Figure 3:
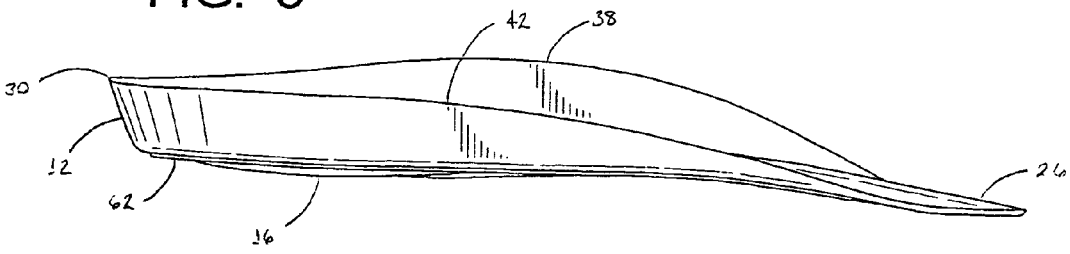
FIG. 3 is an elevational view of the molded orthotic insert of FIGS. 1–2, looking towards the lateral side of the insert, showing the raised lip which extends generally about the perimeter of the heel portion of the insert and to a raised elevation on the medial side thereof.

With further reference to FIG. 1, it can be seen that the insert 10 is configured to extend only over about ¾ of the length of the foot, from the heel end 12 to a curved forward edge 14 that is configured to be positioned just proximal the metatarsal head area of the foot during use. As can be seen in FIG. 2, the forward edge of the insert follows a forwardly curved path, with the end 20 on the medial side being somewhat forward of the end 24 on the lateral side. The material of the insert is comparatively thin in this area, so that the forward end of the device forms a projecting flange portion 26 that engages and supports the foot in the area just behind the metatarsal heads. The ¾-length configuration has a pronounced advantage when used with dress shoes due to the tight toe boxes that are characteristic of such shoes, although a longer configuration that extends under the metatarsal head area or even the full length of the foot.

The lower surface 16 of the insert has a generally flat, slightly convex configuration that corresponds generally to the slightly concave upper surfaces of insoles characteristic of dress shoes. The upper surface 18, in turn, is generally concave and is contoured to engage the plantar surface of the foot. An upwardly-extending wall portion 30 extends around the heel end, with the interior surface being concavely-contoured to form a heel cup 32. A raised arch area 36 is formed forwardly of the heel cup, on the medial side 38 of the insert, and is bounded on its outer edge by a continuation of the upwardly projecting wall 30. A second, significantly smaller raised area 40 is formed on the lateral side 42 generally opposite the arch support.

The upper surface of the insert 10 is consequently provided with an optimal contour for supporting and directing the motion of a foot. In most areas the difference in contour between the upper surface of the insert and the interior of the shoe is adequately achieved by slight variations in the thickness of the plastic material or by creating comparatively small gaps between the device and the insole/sock liner of the shoe. In the raised arch area 36, however, support is provided by a plurality of depending ribs 44, rather than by a solid mass of material.

Since the depending ribs in the arch area provide the insert with several significant advantages, this portion of the device will be described here in detail. The ribs occupy a cutaway recess 46 in the bottom of the insert (see FIG. 4), which lies generally beneath and within the perimeter 48 of the raised arch area (see FIG. 2). The depth of the cutout is sufficient that the thickness of the layer of material that forms the surface of the arch area is substantially the same as in the rest of the device. The cutout extends in a lateral direction only so far as is necessary in order to maintain the layer at more or less the same, minimal thickness, until the layer itself is low enough that its lower surface will contact the insole of the shoe directly; in the preferred embodiment, the cutout will at its maximum extent extend no more than about ¼ of the way across the bottom of the device. This provides support for the raised arch area without creating excessive height in the remainder of the device.

The ribs 44 are arranged generally parallel to one another, and in particular extend generally perpendicular to the long axis of the insert. The straight rather than curved configuration of the ribs (i.e., they extend along a straight line in horizontal cross-section) facilitates both the resistance of the ribs to collapse and the longitudinal bending of the insert, as will be described in greater detail below. Moreover, each of the ribs has a thickness in the horizontal plane that is generally similar to the vertical thickness of the overlying layer. The thickness is selected in combination with the rigidity and other characteristics of the material to ensure that the ribs will not deform or collapse to any significant extent under loads that are exerted by the foot during use, which ensures integrity of the raised arch area 36; as noted above, it is not the purpose of the insert to collapse or compress to "cushion" the foot, but rather to maintain its shape so as to be able to properly control and direct the motions of the foot.

Figure 6:
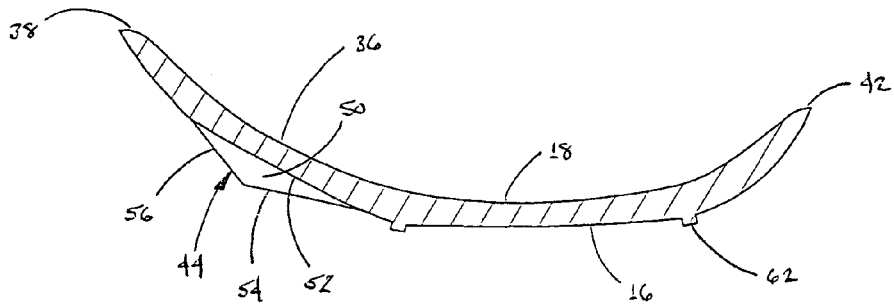
FIG. 6 is a cross sectional view, taken along line 6—6 in FIG. 4, showing the configuration of the ribs in greater detail and also the generally consistent thickness of the material throughout the body of the insert.

As can be seen in FIG. 6, each of the ribs 44 has a somewhat triangular shape, being in the form of a generally planar web 50 having an upper edge that is joined to the overlying layer of material 52. The bottom edges 54 of the ribs are generally flat but angle slightly upwardly towards the outside, so as to correspond generally to the contour of the insole at corresponding, transverse cross-sections. The outer edge 56, in turn, extends at an upward and slightly outward angle, following the general contour of the upwardly extending wall portion 12, so as to accommodate and fit within the confines of the shoe's upper.

When the insert is installed in a shoe, the lower edge 54 of each rib engages the underlying insole/sock liner. The generally flat, straight configuration of the lower edge 54 helps to ensure that a satisfactory load-bearing engagement is achieved between the rib and the insole. Moreover, as can be seen in FIG. 5, the lower edges 54 of the successive ribs are staggered so as to follow a curved path (i.e., somewhat higher towards the rear and curving downwardly towards the front) which corresponds to the curvature of insoles in the arch areas of most dress shoes, thus helping to ensure engagement between the ribs and insole over the full length of the arch area.

Figure 4:
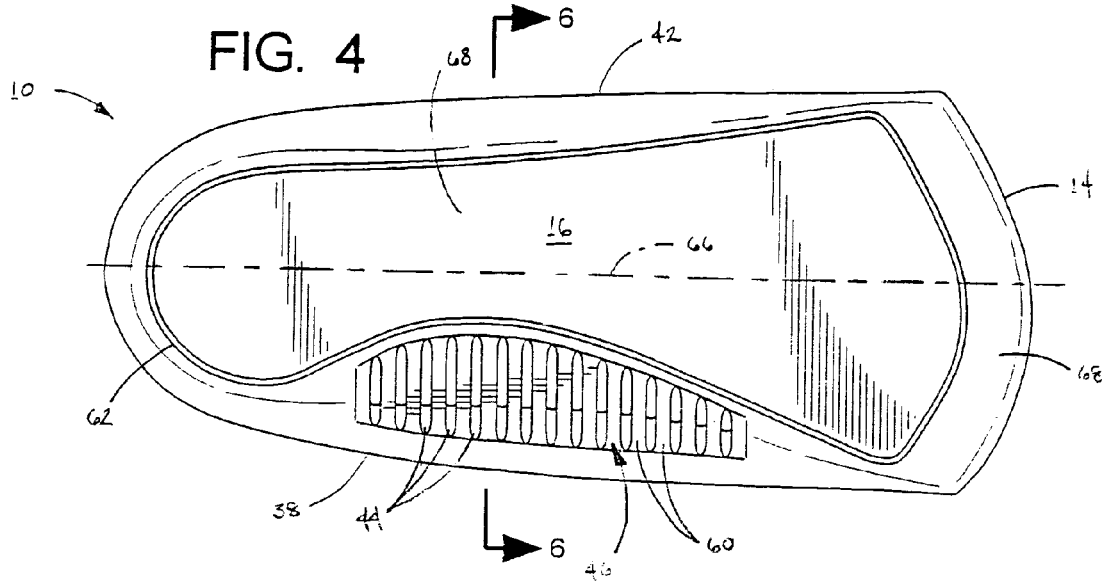
FIG. 4 is a bottom, plan view of the molded orthotic insert of FIGS. 1–3, showing the depending ridge that extends generally about the periphery of the insert and its relationship to the ribbed arch area in greater detail.
Figure 5:
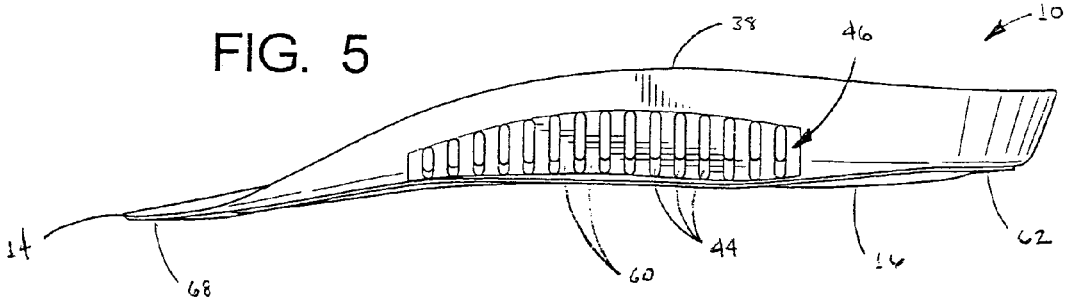
FIG. 5 is an elevational view of the molded orthotic insert of FIGS. 1–4, looking towards the medial side of the insert, showing the relationship of the molded ribs and raised arch of the insert in greater detail.

As can be seen in FIGS. 4–5, the height of the individual ribs is somewhat greater towards the middle of the arch area and lower towards the ends, so that the upper ends of the ribs follow the curve of the raised arch area and ensure the more or less constant thickness of the overlying layer 52. Moreover, the ribs are separated by gaps 60, which are all of substantially equal width in the preferred embodiment. The number and spacing of the ribs, and the width of the gaps 60, are again selected relative to the rigidity of the material to ensure that there is no substantial collapse or deformation of the overlying layer 52 of the arch area 36. In particular, if the gaps are too wide and the ribs too few, the overlying layer 52 (see FIG. 6) will tend to bend downwardly and deform under the pressure of the foot in the areas between the supporting ribs, depending on the rigidity of the material. On the other hand, use of too many ribs may render the individual ribs too thin and flimsy to resist compression or bending under a load, while too wide of ribs or too small of gaps may result in excessive thickness and may compromise the ability of the insert to flex along its lengthwise axis, as will be described in greater detail below. In the illustrated embodiment, using a moderately stiff molded termoplastic (polypropylene) having a durometer of about 55 Shore D, there are 15 ribs, each of which is approximately 3 mm thick, separated by gaps of approximately 3 mm. The main layer 52 of the insert is likewise about 3 mm thick over most of its extent, although as noted above it may vary slightly in order to provide the desired contour.

A narrow, depending ridge 62 extends generally around the bottom of the insert 10. As can be seen in FIGS. 1 and 4, the ridge serves to press into and engage the material of the insole or sock liner so as to stabilize the insert and hold it in position. This feature makes it possible to form the insert as a unitary, one-piece device using a molded, hard-surfaced plastic material that is inexpensive and durable and will not bind against the wearer's sock, but without the problem of the insert sliding or shifting about inside the shoe during use. Since the purpose of the ridge is to bed or "dig" into the surface of the insole to an extent sufficient to hold the insert in place but without damaging the material of the insole, it is important that the ridge be quite narrow and not project excessively below the bottom surface 16 of the insert; in the preferred embodiment that is illustrated, the ridge 62 suitably has a width of about 1 mm and a height of about 0.75 mm, which is eminently suitable for use with the insoles constructed of leather or similar materials that are typical of most dress shoes.

As can be seen in FIG. 4, the ridge 62 closely follows the outer edge of the lower surface 16 over most of its perimeter, being spaced inwardly therefrom by a short distance, suitably about 2–3 mm. This ensures that the insert is stabilized in all directions and under a full range of motions of the foot. In two areas, however, the ridge is spaced inwardly from the edge by a significantly greater distance. First, in the arch area, the ridge follows and is spaced inwardly a short distance (e.g., 2–3 mm) from the lower/inner edge 64 of the arch support cutout 46. The ridge therefore follows a generally inward, concave curve in this area, however, as is shown in FIG. 4, it is important that the ridge nevertheless be on the medial side of the centerline 66 of the device in this area. This helps ensure resistance against sliding/shifting in a transverse direction when the insert is medially loaded, since the lower surface 16 projects convexly in the area 68 between the two sides of the ridge in order to fit with and form a load-bearing engagement against the insole in this area. Likewise, as noted above, it is important that the cutout and ridges be confined to the medial side of the centerline in this area.

As can be seen with further reference to FIG. 4, the ridge 62 is spaced well rearwardly of the forward edge 14 of the insert. This forms a protrusion-free border 68 along the front of the device, allowing the material to taper down smoothly to the forward edge 14 and avoiding any raised edges or bumps that might be felt behind the ball of the foot, which is especially sensitive to irregularities/pressure.

Figure 7:
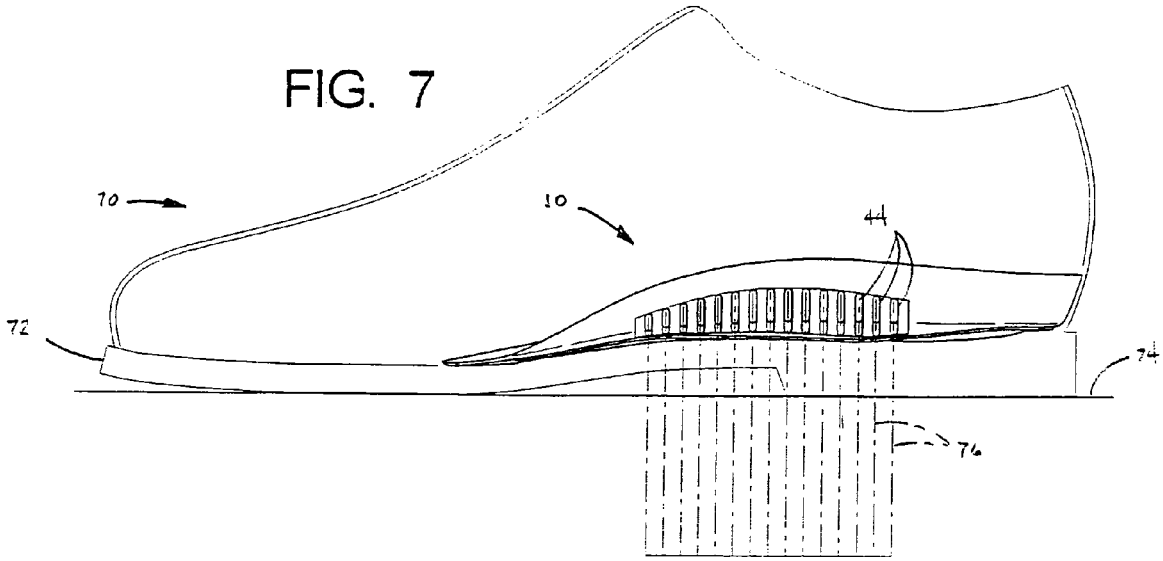
FIGS. 7 and 8 are first and second elevational views of the molded orthotic insert of FIGS. 1–5 placed in a conventional dress shoe, showing the manner in which the ribs allow the arch area to flex together with the foot and the insole of the shoe by resiliently spreading apart towards their lower ends.
Figure 8:
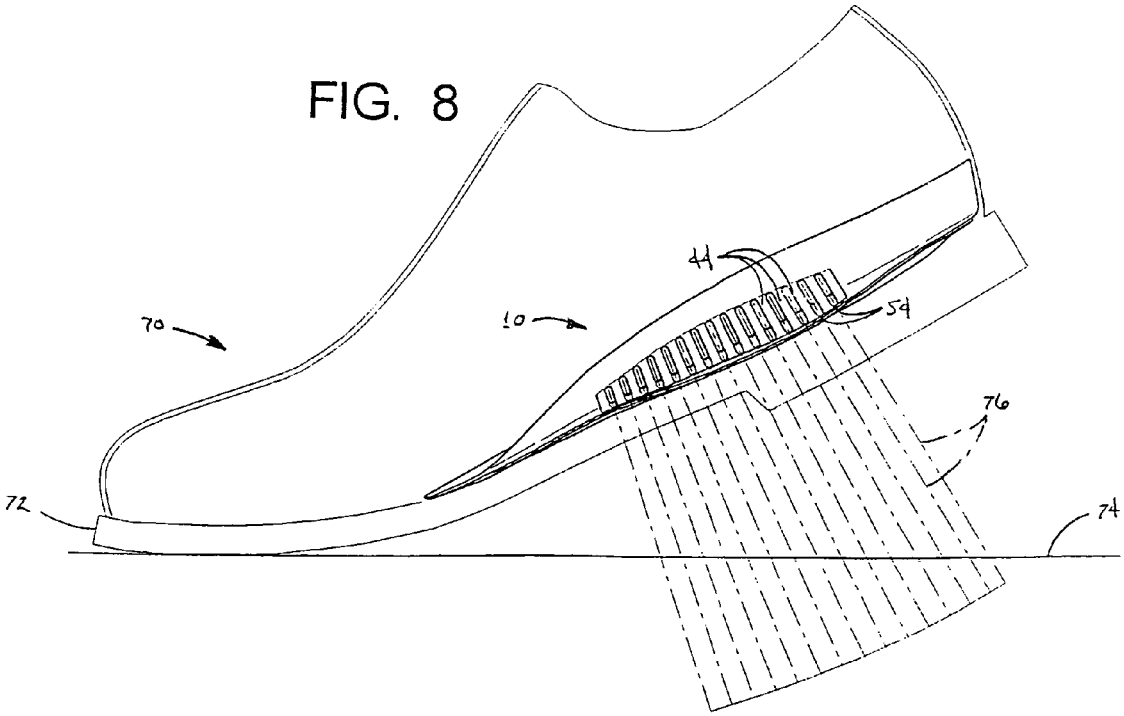

FIGS. 7–8 show the insert 10 installed within a conventional dress shoe 70. As noted above, the configuration of the separate ribs 44 enable these to provide support for the raised arch area of the device while at the same time permitting it to bend resiliently along its long axis; in particular, the use of the separated ribs (as opposed to a solid structure) enables the arch support to bend together with the remainder of the insert more or less uniformly, due to the ability of the ribs to spread apart at their lower edges and also the more or less constant thickness of the main layer throughout this area.

FIG. 7 shows the configuration that is assumed by the insert 10 when the shoe 70 is flat on the ground with the sole/insole 72 in contact with the underlying surface 74, as occurs in the foot is at the midpoint in its gait cycle (or when the wearer is simply standing). In this position, the insert 10 is in its initial configuration, with the ribs 44 extending parallel to one another as indicated by dotted lines 76, which represent vertical extensions of the planes of the ribs.

As the foot moves towards toe-off, as shown in FIG. 7, the insole of the shoe flexes resiliently so as to bend through a generally convex arc, this being necessary in order to accommodate the changing form of the foot. Simultaneously, the ribs 44 spread apart at their lower edges 54, as indicated by dotted lines 76. The principle resistance to the bending of the insert (along the long axis) is therefore provided by the main layer of material 52 over the ribs, and since (as described above) this layer has a more or less constant thickness all the way across the device the bending action is substantially uniform and without added resistance or distortion in or around the arch area.

The insert thus flexes smoothly and resiliently throughout the gait cycle without compromising the shape that is critical to directing the motions of the foot. Moreover, the ribs maintain a generally perpendicular/normal orientation relative to the insole throughout the gait cycle, so that they effectively resist compression from bending/folding and thereby provide firm, continuous support for the raised arch area of the device.

The insert of the present invention consequently achieves significant functional advantages that have previously been associated with custom orthotics, namely a rigid and resiliently flexible (but not compressible) insert that has a shape for properly controlling and directing the motions of the foot, and that retains the correct shape over the whole duration of the gait cycle. Moreover, these advantages are achieved in a unitary structure that is economically formed of molded plastic. In particular, the generally constant thickness of the material throughout the insert (in addition to providing the functional advantages described above) makes it feasible to produce the orthotic insert of the present invention using rapid and economical injection molding processes: because of the generally uniform thickness, the device can be "shot" efficiently and quickly using conventional injection molding equipment and inexpensive plastic materials, and this also ensures an even cooling and curing of the material throughout the device that effectively eliminates any possibility of warping or other deformation that might distort the shape of the product and compromise its ability to function properly with the foot.

It is to be recognized that various alterations, modifications, and/or additions may be introduced into the constructions and arrangements of parts described above without departing from the spirit or ambit of the present invention as defined by the appended claims.

What is claimed is:

1. An orthotic insert, comprising:

a one-piece body having an upper surface shaped to engage a plantar surface of a foot so as to control and direct the motions thereof, said insert being formed unitarily of a molded rigid, resiliently flexible, substantially non-compressible material, said body having sufficient rigidity that substantially the whole of said upper surface will not deform or collapse under said foot;

a raised arch portion formed on a medial side of said one-piece body;

a cutout area formed in said body below said arch portion so that an upper layer of said molded material has a thickness in said arch portion that is substantially uniform with a thickness of said material in a remainder of said body; and a plurality of generally vertical ribs formed on said body in said cutout area, said ribs extending downwardly from said upper layer of molded material and having lower edges for engaging an insole of a shoe, so that said ribs will support said arch area and prevent said upper layer of material from collapsing and changing shape under said foot.

2. The orthotic insert of claim 1, wherein said plurality of ribs extends generally parallel to one another and perpendicular to a lengthwise axis of said insert.

3. The orthotic insert of claim 2, wherein said each of said ribs is separated from adjacent ribs by a spaced gap over substantially a full height thereof, from said upper layer to said lower edges of said ribs.

4. The orthotic insert of claim 3, wherein each of said ribs is substantially straight in horizontal cross-section and extends in a plane substantially perpendicular to said lengthwise axis of said insert.

5. The orthotic insert of claim 4, wherein each of said ribs comprises:

a generally horizontally extending lower edge for engaging an insole of a dress shoe; and a generally upwardly extending outer edge for accommodating an upper portion of said shoe;

said lower and outer edges of said ribs being free from attachment to edges of adjacent ribs.

6. The orthotic insert of claim 5, wherein said ribs terminate a spaced distance medially from a lengthwise centerline of said insert, so that a central portion of a lower surface of said insert is free of said ribs so as to have minimal height generally along a lengthwise centerline of said shoe.

7. The orthotic insert of claim 6, further comprising:

a depending ridge formed on said body generally around a perimeter of said lower surface thereof, for penetrating into an insole of a shoe in response to pressure exerted downwardly on said insert by a foot, so as to stabilize said insert against sliding or shifting in said shoe.

8. The orthotic insert of claim 7, wherein said central portion of said lower surface of said insert is generally convexly curved so as to conform to a concavely curved insole, and said depending ridge extends between said lengthwise centerline of said insert and said ribs so as to be able to engage said insole when said insert is loaded on said medial side thereof.

9. The orthotic insert of claim 7, wherein said insert is a ¾-length insert having a forward edge configured to be positioned proximal a metatarsal head area of said foot, and wherein said depending ridge extends at a spaced distance therefrom so as to form a thin forward lip for being position beneath and proximal said metatarsal head area of said foot.

10. The orthotic insert of claim 5, wherein each of said ridges has a thickness generally similar to said thickness of said material in said upper layer of said body.

11. The orthotic insert of claim 10, wherein said rigid, resiliently flexible, substantially non-compressible material is injection-molded plastic.

* * * * *